US008882395B2

(12) United States Patent
Kim

(10) Patent No.: US 8,882,395 B2
(45) Date of Patent: Nov. 11, 2014

(54) TENSION DISPERSION-TYPE COMPLEX ANCHOR BODY WITH A REMOVABLE TENSION MEMBER, AND METHOD FOR CONSTRUCTING SAME

(75) Inventor: Jeong-Ryeol Kim, Gyeonggi-do (KR)

(73) Assignee: Samwoo Geotech Co., Ltd., Seoul (KR)

( * ) Notice: Subject to any disclaimer, the term of this patent is extended or adjusted under 35 U.S.C. 154(b) by 276 days.

(21) Appl. No.: 13/321,711

(22) PCT Filed: May 20, 2010

(86) PCT No.: PCT/KR2010/003192

§ 371 (c)(1),
(2), (4) Date: Nov. 21, 2011

(87) PCT Pub. No.: WO2010/134765

PCT Pub. Date: Nov. 25, 2010

(65) Prior Publication Data

US 2012/0070235 A1 Mar. 22, 2012

(30) Foreign Application Priority Data

May 20, 2009 (KR) ..... 10-2009-0043796
Sep. 10, 2009 (KR) ..... 10-2009-0085561

(51) Int. Cl.
*E02D 5/80* (2006.01)
*E02D 5/74* (2006.01)

(52) U.S. Cl.
CPC ... *E02D 5/74* (2013.01); *E02D 5/80* (2013.01)
USPC ..... 405/259.4

(58) Field of Classification Search
USPC ..... 405/259.1, 259.4, 259.5, 302.2
See application file for complete search history.

(56) References Cited

U.S. PATENT DOCUMENTS

| | | | | | |
|---|---|---|---|---|---|
| 4,160,615 | A | * | 7/1979 | Baldwin | 405/259.3 |
| 5,253,960 | A | * | 10/1993 | Scott | 405/302.2 |
| 5,511,909 | A | * | 4/1996 | Calandra et al. | 405/259.6 |
| 5,829,922 | A | * | 11/1998 | Calandra et al. | 405/302.2 |
| 6,074,134 | A | * | 6/2000 | Stankus et al. | 405/259.6 |
| 8,251,617 | B2 | * | 8/2012 | Leppanen | 405/302.2 |

FOREIGN PATENT DOCUMENTS

| | | | | | |
|---|---|---|---|---|---|
| GB | 2144784 | A | * | 3/1985 | E02D 5/80 |
| JP | 55-092737 | U | | 6/1980 | |
| JP | 2002-266347 | | | 9/2002 | |
| KR | 20-0261932 | | | 4/2002 | |
| KR | 20-0313707 | | | 5/2003 | |
| KR | 10-0473789 | | | 3/2005 | |
| KR | 20-0375568 | | | 3/2005 | |

* cited by examiner

*Primary Examiner* — Tara M. Pinnock
(74) *Attorney, Agent, or Firm* — IP & T Group LLP

(57) ABSTRACT

A tension dispersion type complex anchor device includes an internal fixing body having a tension member which is placed through a free length section to apply a tension force and a fixing block to which a wedge assembly for grasping a distal end of the tension member is mounted; a connection medium unit for mounting the internal fixing body to one end thereof; a grip sleeve coupled to the other end of the connection medium unit; and a permanent anchor fixed by being fitted into the grip sleeve to provide an allowable anchoring force through a bonded length section.

12 Claims, 10 Drawing Sheets

Detail "A"

SECTION a-a'

SECTION b-b'

Detail "B"

Detail "C"

TENSION DISPERSION-TYPE COMPLEX ANCHOR BODY WITH A REMOVABLE TENSION MEMBER, AND METHOD FOR CONSTRUCTING SAME

This application is a national stage application of PCT/KR2010/003192 filed on May 20, 2010, which claims priority of Korean patent application numbers 10-2009-0043796 filed on May 20, 2009 and 10-2009-0085561 filed on Sep. 10, 2009. The disclosure of each of the foregoing applications is incorporated herein by reference in its entirety.

TECHNICAL FIELD

The present invention relates to a complex ground anchor device and a method for constructing the same, and more particularly, to a tension dispersion type complex anchor device with a removable tension member in which a permanent fixing type anchor and a removable tension dispersion type anchor are detachably combined so that a permanent anchoring force can be secured through a bonded length section and the tension member positioned through a free length section can be easily removed, and a method for constructing the same.

BACKGROUND ART

In general, a ground anchor device is used in the field of public works as a construction material for stably maintaining a structure from excessive stress, deformation, displacement, etc. occurring in the ground, by fastening a high strength tension member, such as a PC steel wire, both to the structure and the ground and then applying a prestress to the tension member.

Ground anchor devices can be divided into a tension type anchor device, a compression type anchor device, and a load dispersion type anchor device for dispersing a load in the tension type anchor device and the compression type anchor device, depending upon a supporting type of a mounting ground.

Referring to FIGS. 1 and 2, a tension type anchoring method is a method in which a tension member 104 is inserted into a borehole defined in the ground, a grout 102 is filled in the borehole and a tension is applied to the tension member 104 so that the ground is supported by a frictional force between the ground and the grout 102. The tension type anchoring method suffers from defects in that, since a crack is likely to be created in the grout 102 by the tension applied to the tension member 104 and a progressive failure is likely to occur by a creep due to the concentration of a load, load decrease becomes substantial. Accordingly, in the graph of FIG. 2 showing a skin friction distribution, while a load transition distribution of the load curve 1 representing initial loading is obtained in an initial load application stage, the load curve 3 is resultantly obtained due to creep rupture, etc. with the lapse of time, by which a load decreases. Also, when the tension force is applied to the tension member 104, although an originally designed load curve is anticipated, a load concentration section exceeds the ultimate uplift capacity of a target ground. As a result, a load is decreased as in the load curve 2 and is fixed to the load curve 3. This mainly results from decrease in local frictional force due to load concentration.

Referring to FIGS. 3 and 4, a compression type anchoring method is a method in which PC steel strands coated with polyethylene (PE) are confined to a separate fixing body 106 to generate a compression force in a grout 102. In the compression type anchoring method, since tension is applied to the fixing body 106 via a tension member 104 and the fixing body 106 compresses the grout 102, load decrease due to a creep is reduced when compared to the tension type anchoring method. However, the compression type anchoring method has a drawback in that, since a grout with a high strength should be used, it is difficult to secure a predetermined anchoring force in a relatively soft ground. Also, as can be seen from FIG. 3 showing load changes, load concentration of the compression force applied to the grout 102 occurs on a distal end. Such a load concentration may break the grout 102. Further, in the case where it is necessary to apply a load exceeding an ultimate frictional force, disadvantages are caused in that the diameter of a borehole should be increased or bonding should be implemented with respect to a rock with a high surrounding confinement pressure. In the compression type anchor device, similar to the tension type anchor, load decrease occurs (see FIG. 3 showing load changes), and an abrupt load decrease may occur due to a compressive failure. As can be seen from FIG. 4 as a graph of a skin friction distribution, in the case of a load concentration type anchor, a load transition distribution changes from the load curve 1 to the load curve 3, by which a load decreases.

Referring to FIGS. 5 and 6, a load dispersion type anchoring method is a method in which the disadvantages of the tension type anchoring method and the load concentration type anchoring method are overcome and tension type anchors are dispersed to various portions. In the load dispersion type anchoring method, an extreme load concentration should not be occur in a bonding ground and a grout 102, PC steel strands coated with PE should be used not to confine a free part, and it should be easy to adjust an allowable anchoring force depending upon a ground condition. In the case of a load dispersion tension type anchor device, since a load is applied to a number of tension members 104 in a dispersed manner, an influence on the strength of the grout 102 becomes flimsy and a predetermined anchoring force can be secured even in a relatively soft ground. As a consequence, a high load as in a rock can be exhibited in a general soil ground.

In the load dispersion type anchor, as can be seen from FIGS. 5 and 6 showing a load distribution diagram and a graph of a skin friction distribution, since a load is applied to the ground in a dispersed manner, load decrease becomes very small, and an initial load distribution can be maintained regardless of a time.

The above-mentioned load dispersion type anchor device is disclosed in Korean Utility Model Registration No. 0375568 entitled "Frictional Force and Tension Dispersed Composite Ground Anchor" which was filed and registered in the name of the present applicant. That is to say, the above-mentioned complex ground anchoring method is a method in which, as shown in FIG. 7, fixing anchors a, b and c positioned in a bonded length section are arranged in such a way as to define step-like shapes and respective tension members 221*a*, 221*b* and 221*c* positioned in free length sections are removed from a fixing block 220 after construction is completed. In this anchoring method, a large anchoring force can be secured when compared to the tension type anchor device or the compression type anchor device in which tension members are arranged in line.

The unexplained reference numeral 222 designates spacer members.

In the structure of the complex ground anchor device, as shown in FIG. 8, a cap 225 is threadedly coupled to the fixing block 220, and the fixing anchor a fixed to a squeezing sleeve 231 is connected through the cap 225.

DISCLOSURE

Technical Problem

In the structure, when a tension force is applied to the fixing anchor a, since the cap 225 may be released from the fixing block 220 by the tension force, tension cannot be applied to the fixing anchor a. In addition, because the fixing anchor a is fixed to the fixing block 220, a problem is caused in that it is difficult to adjust an allowable anchoring force that varies depending upon a ground condition of each field.

Moreover, an internal fixing body, in which the tension members 221 are mounted to the fixing block 220, is placed on the market by being packed into a circular bundle upon manufacture. Accordingly, it is difficult to manufacture an anchor device in the state in which the fixing anchor a substantially not coated and the internal fixing body are integrated with each other, and it is also difficult to transport the anchor device.

Technical Solution

Embodiments of the present invention are directed to a tension dispersion type complex anchor device with a removable tension member, in which a permanent fixing type anchor positioned through a bonded length section and a removable type anchor positioned through a free length section are constructed together to be capable of being separated and combined from and with each other so that a permanent anchoring force can be secured by applying a necessary tension force to the permanent fixing type anchor and the removable type anchor positioned through the free length section can be simply removed, and a method for constructing the same.

Another embodiment of the present invention is directed to a tension dispersion type complex anchor device with a removable tension member, in which a removable load dispersion type anchor can be separated from a permanent fixing type anchor so that only the removable load dispersion type anchor can be manufactured to be capable of being packed and in which an allowable anchoring force can be adjusted according to the ground conditions of different work fields, and a method for constructing the same.

In accordance with an embodiment of the present invention, a tension dispersion type complex anchor device includes: a tension member placed through a free length section to apply a tension force; a fixing block mounted with a wedge assembly for grasping a distal end of the tension member; a connection medium unit for mounting the internal fixing body to one end thereof; a grip sleeve coupled to the other end of the connection medium unit; and a permanent anchor fixed by being fitted into the grip sleeve to provide an allowable anchoring force through a bonded length section.

In accordance with another embodiment of the present invention, a method for constructing a tension dispersion type complex anchor device includes: a first step of forming a complex anchor device by grasping a distal end of a tension member by a wedge assembly of a fixing block and threadedly coupling a body of the fixing block and a grip sleeve squeezed against a permanent anchor to both ends of a coupler; a second step of fitting block spacers around couplers of at least two complex anchor devices, fitting tension members of adjacent complex anchor devices into grooves of the block spacers fitted around the couplers, and inserting the complex anchor devices into an anchor hole such that permanent anchors of the complex anchor devices are arranged in such a way as to define step-like shapes; a third step of filling a grout into the anchor hole and fixing the grout, applying a tension force to the tension members, and fixing the complex anchor devices to an external fixing body which is installed on a slope; a fourth step of cutting the tension members fixed by the external fixing body using a welding machine after anchoring construction is completed, and thereby releasing a tension force; a fifth step of pushing wedge assemblies grasping the tension members as a reaction force corresponding to the tension force is applied to the tension members, and thereby a wedging force of the tension members is released; and a sixth step of taking out the tension members from fixing blocks.

Advantageous Effects

According to the embodiments of the present invention, the following effects are achieved.

First, a complex anchor device is formed by mounting a coupler to an internal fixing body having a tension member mounted thereto and by threadedly coupling a permanent anchor to the coupler. By inserting the complex anchor device into an anchor hole and applying a tension force to the complex anchor device, compression dispersion is induced between the internal fixing body and a grout in a free length section, and a frictional force is increased between the ground and the grout in a bonded length section. As a consequence, it is possible to secure a large anchoring force when compared to the conventional tension type anchor device or load concentration type anchor device.

Second, at least two complex anchor devices, each of which is formed by coupling an internal fixing body and a permanent anchor to both ends of a coupler, are combined in such a manner that the permanent anchors of these complex anchor devices are arranged in a bonded length section to define step-like shapes, so that a tensile load can be dispersed in the bonded length section. According to this fact, since a creep phenomenon by a load can be minimized, a support force can be maximized not only in a general soil ground but also in a soft ground, and ground stabilization can be reliably ensured.

Third, because the permanent anchor can be separated from the complex anchor device, only the internal fixing body with a tension member mounted to a fixing block can be packed upon manufacture and be placed on the market. In this regard, since the permanent anchor can be assembled to the internal fixing body at a field, construction can be easily carried out in place.

Fourth, since a tension force is applied with a grip sleeve of the permanent anchor threadedly coupled to the internal fixing body, an allowable anchoring force can be adjusted according to ground conditions of different fields.

BEST MODE

Figure 1:
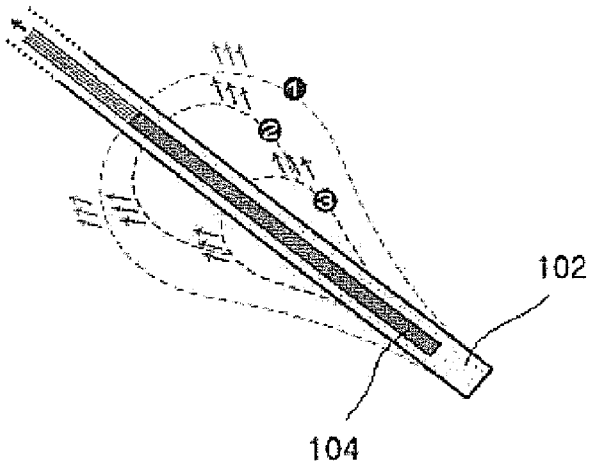
FIGS. 1 and 2 are a conceptual view and a graph of a skin friction distribution, explaining load changes in a conventional tension type anchoring method.
Figure 2:
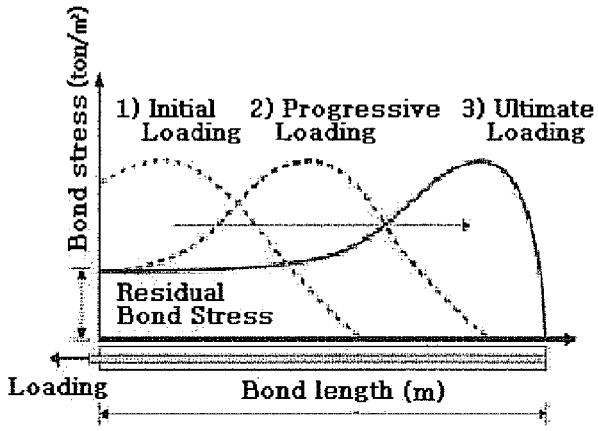
Figure 3:
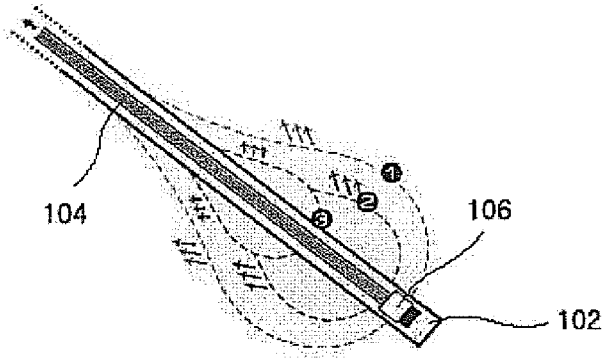
FIGS. 3 and 4 are a conceptual view and a graph of a skin friction distribution, explaining load changes in a conventional compression type anchoring method.
Figure 4:
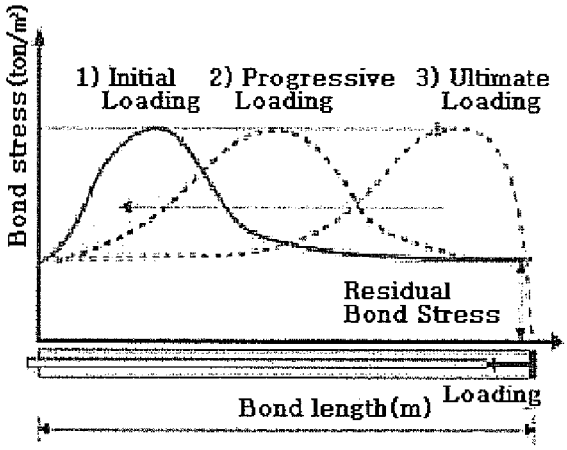
Figure 5:
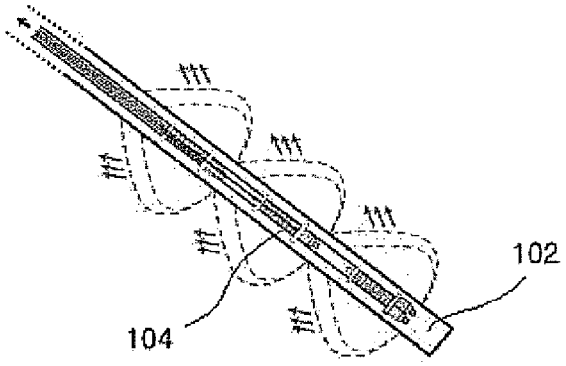
FIGS. 5 and 6 are a conceptual view and a graph of a skin friction distribution, explaining load changes in a conventional load dispersion type anchoring method.
Figure 6:
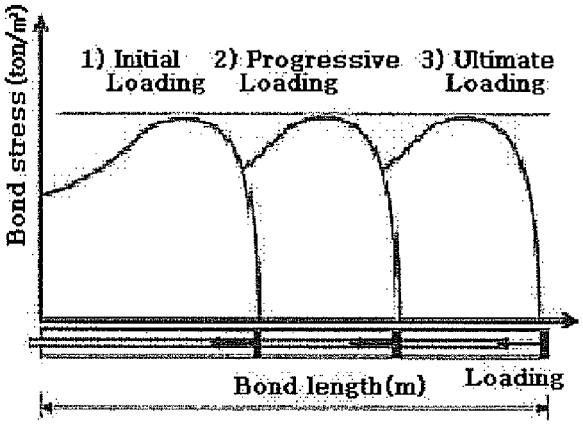
Figure 7:
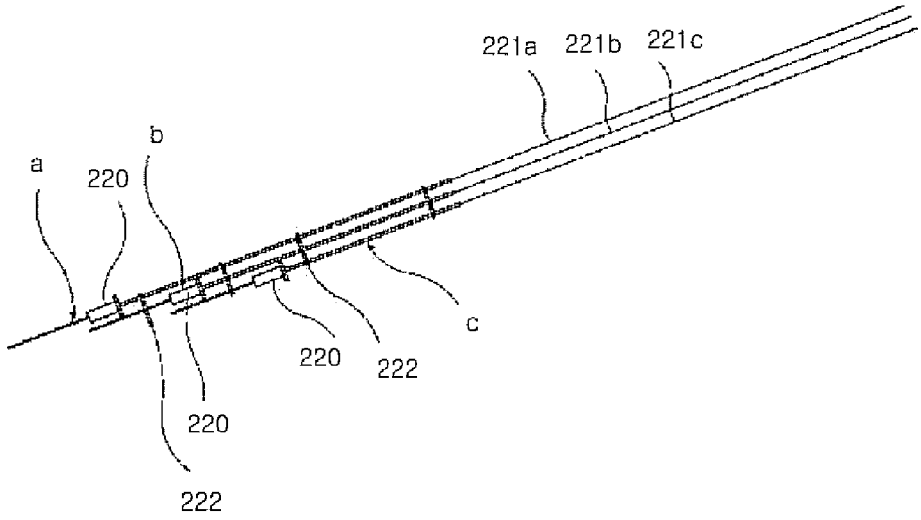
FIG. 7 is a schematic view illustrating the configuration of a conventional complex anchor device.
Figure 8:
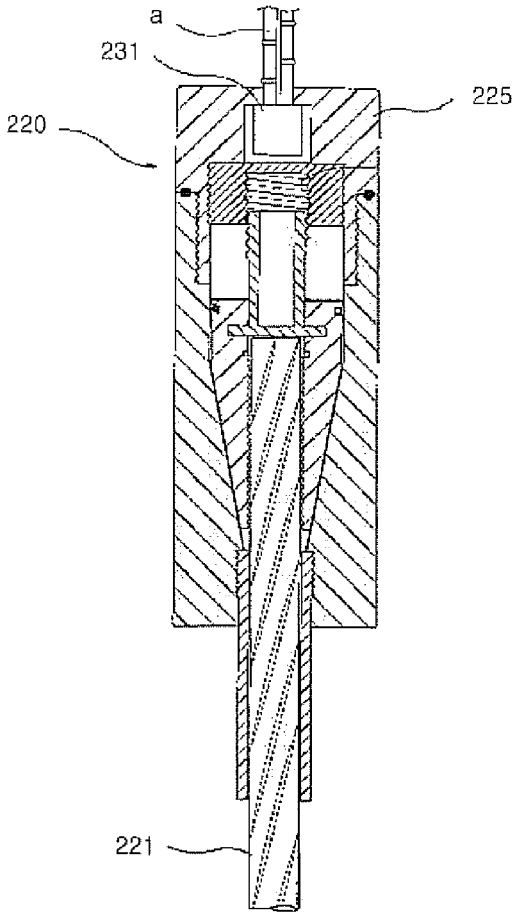
FIG. 8 is a cross-sectional view illustrating the configuration of the anchor fixing body shown in FIG. 7.

Exemplary embodiments of the present invention will be described below in more detail with reference to FIGS. 9 to 18. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

In a tension dispersion type complex anchor device with a removable tension member and a method for constructing the same according to embodiments of the present invention, a permanent anchor positioned in a bonded length section and an internal fixing body positioned in a free length section are realized to be capable of being separated from and combined with each other, so that a support force can be maximized not only in a general soil ground but also in a soft ground, whereby the stability of the ground can be reliably ensured.

Figure 9A:
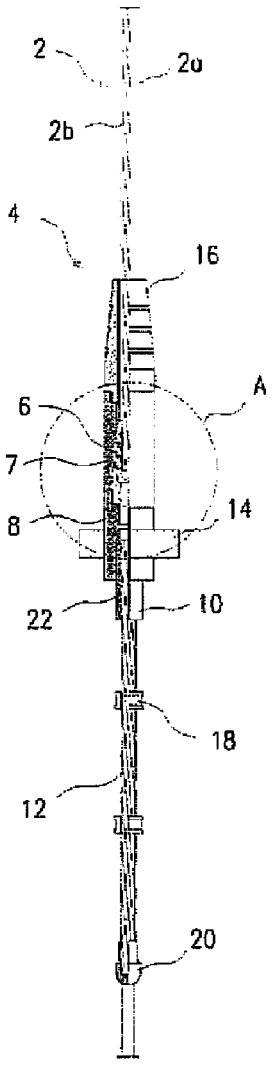
FIGS. 9A and 9B are partially cross-sectioned views illustrating the configuration of a tension dispersion type complex anchor device with a removable tension member in accordance with a first embodiment of the present invention.
Figure 9B:
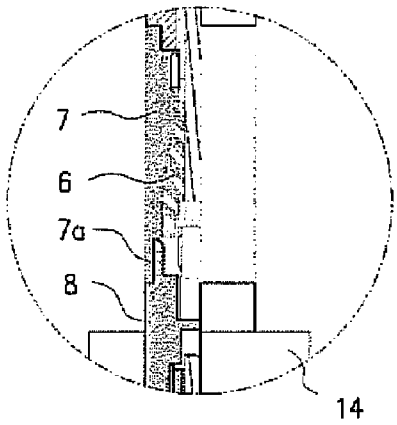
Figure 10:
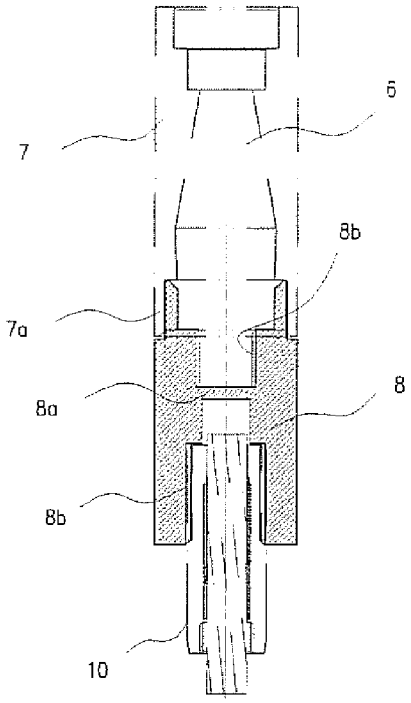
FIG. 10 is a cross-sectional view illustrating the state in which an anchor support and a permanent anchor are assembled to a coupler in the first embodiment of the present invention.
Figures 11A, 11B:
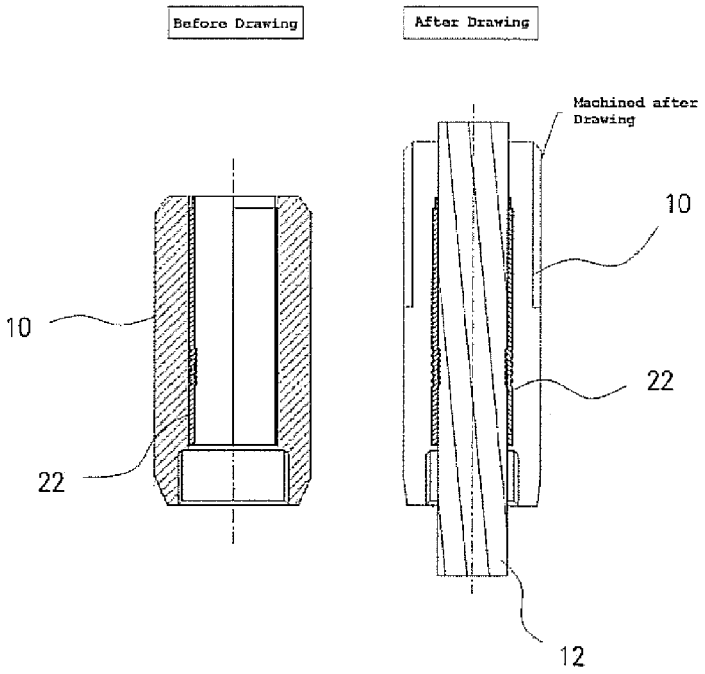
FIGS. 11A and 11B are cross-sectional view views illustrating a manufacturing process in which a grip sleeve is squeezed against the permanent anchor in the first embodiment of the present invention.

FIG. 9 is a partially cross-sectioned view illustrating the configuration of a tension dispersion type complex anchor device with a removable tension member in accordance with a first embodiment of the present invention, FIG. 10 is a cross-sectional view illustrating the state in which an anchor support and a permanent anchor are assembled to a coupler in the first embodiment of the present invention, and FIG. 11 is a cross-sectional view illustrating a manufacturing process in which a grip sleeve is squeezed against the permanent anchor in the first embodiment of the present invention.

Referring to these drawings, the tension dispersion type complex anchor device in accordance with the first embodiment of the present invention includes having a tension member 2 placed through a free length section to apply a tension force; an internal fixing body 4 having a wedge assembly 6 which grasps the distal end of the tension member 2 to induce a tension force and to allow the tension member 2 to be removed when the tension force is released and a fixing block 7 into any by which the wedge assembly 6 is fitted and supported; a coupler 8 having one end to which the fixing block 7 is mounted; a grip sleeve 10 coupled to the other end of the coupler 8; a permanent anchor 12 having the shape in which a number of strands of PC steel wires are twisted, and fitted into and squeezed by the grip sleeve 10 to provide an allowable anchoring force through a bonded length section; a block spacer 14 fitted around the coupler 8 and defined on a circumferential outer surface thereof with a plurality of grooves 14*a* in each of which the tension member 2 is fitted and supported; and an anchor body 16 installed on one end of the fixing block 7 to reinforce the tension member 2, ensure waterproofness and prevent the steel wires from being released.

Also, the tension dispersion type complex anchor device in accordance with the first embodiment of the present invention further includes at least one strand grip 18 fitted around the permanent anchor 12 to increase a coupling force with respect to the grout filled in the bonded length section and thereby secure an allowable tension force due to an increase in frictional force; and a support cone 20 fitted around the proximal end of the permanent anchor 12 to prevent the PC steel wire strands constituting the permanent anchor 12 from being untwisted.

In the above-described configuration, the tension member 2 has a structure in which a PC steel wire 2*a* formed by twisting a number of strands is covered by a PE tube 2*b*.

The internal fixing body 4 in which the tension member 2 is mounted to the wedge assembly 6 of the fixing block 7 may adopt any one of bat type structures as disclosed in Korean Patent Nos. 0418466 and 0435070 and Korean Utility Model Registration No. 0242474 and swing type structures as disclosed in Korean Patent Nos. 0411567 and 0435069, which are filed and registered in the name of the present applicant. Thus, the detailed descriptions for well-known component elements of the internal fixing body 4 will be omitted herein.

Among the component elements of the internal fixing body 4, the fixing block 7 is differentiated from those disclosed in the above-described patent or utility model documents in that an internal thread 7*a* to be threadedly coupled with the coupler 8 is formed on the distal end thereof.

In the present embodiment of the invention, the strand grip 18 has a cylindrical shape which is concavely rounded at the intermediate portion thereof. However, the strand grip 18 is not limited to such a shape, and any shapes capable of increasing a coupling force with respect to the grout may be employed. For example, it is to be understood that the strand grip 18 may have the shape of a polygonal block such as a trapezoid and a quadrangle or the shape of a disc.

Referring to FIG. 10, the coupler 8 is constituted by a cylindrical block which is formed with a partition wall 8*a* at the middle portion thereof and both ends of which are formed with internal threads 8*b*. Also, the coupler 8 is formed with an external thread on one end thereof to be threadedly coupled with the internal thread 7*a* formed in the fixing block 7.

The grip sleeve 10 is formed with an external thread on the circumferential outer surface thereof to be locked into the internal thread 8*b* of the coupler 8 without causing a reduction in sectional area, so that the tension force applied to the permanent anchor 12 can be sufficiently sustained by the locking force. Due to such a separable structure between the internal fixing body 4 and the permanent anchor 12, the internal fixing body 4 can be packed together with the tension member 2 upon manufacture in a factory and thus be easily transported. By locking the internal fixing body 4 with the permanent anchor 12 by the medium of the coupler 8 at a field, an anchor construction can be simply carried out at the field.

Referring to FIG. 11, the permanent anchor 12 fitted into the grip sleeve 10 is fixed by squeezing through a drawing process. An insert plate 22 for increasing the fixing force of the permanent anchor 12 is attached to the inner surface of the grip sleeve 10. When the grip sleeve 10 is drawn through a dice (not shown), the diameter of the grip sleeve 10 is decreased, and the insert plate 22 is squeezed against and integrated with the permanent anchor 12, as shown in the right side drawing of FIG. 11.

The complex anchor device configured and assembled as described above is inserted into an anchor hole and provides a tension force in cooperation with the grout.

Hereafter, an exemplary construction of the complex anchor device in accordance with the first embodiment of the present invention will be described with reference to FIGS. 12 to 14.

Figure 12:
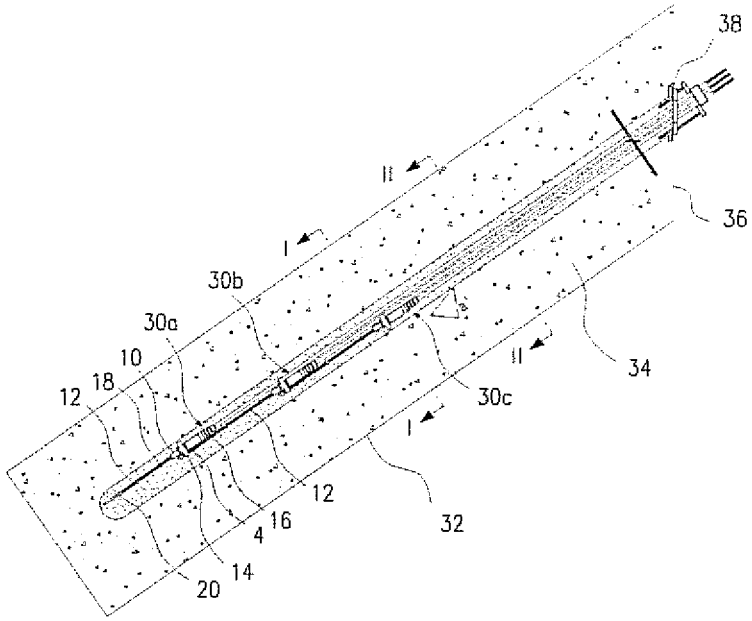
FIG. 12 is a view illustrating an exemplary method for constructing the tension dispersion type complex anchor device with a removable tension member in accordance with the first embodiment of the present invention.
Figure 13:
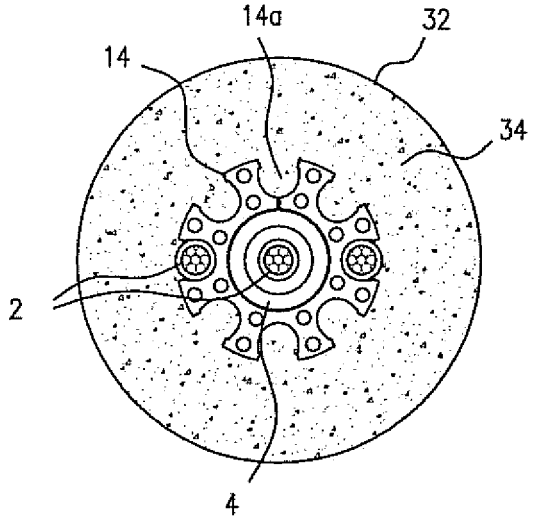
FIG. 13 is a cross-sectional view taken along the line a-a' of FIG. 12.
Figure 14:
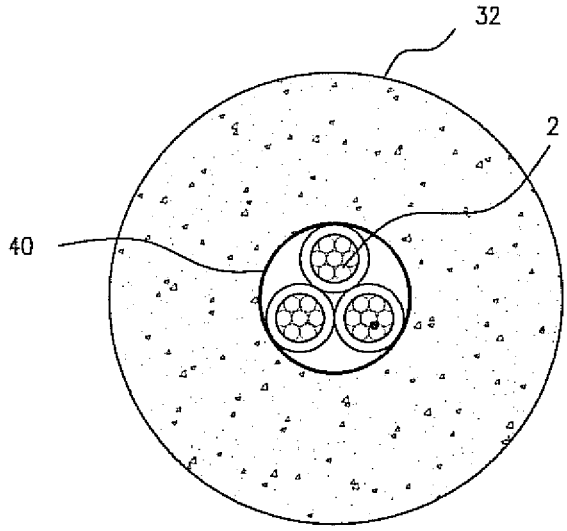
FIG. 14 is a cross-sectional view taken along the line b-b' of FIG. 12.

FIG. 12 is a view illustrating an exemplary method for constructing the tension dispersion type complex anchor device with a removable tension member in accordance with the first embodiment of the present invention, FIG. 13 is a cross-sectional view taken along the line a-a' of FIG. 12, and FIG. 14 is a cross-sectional view taken along the line b-b' of FIG. 12.

In this construction example, the internal fixing body 4 adopts "An Inner Fixing Body for a Tension Member Removal Type Ground Anchor" disclosed in Korean Patent No. 0435069, as a swing type.

The complex anchor device in accordance with the first embodiment of the present invention can be mainly applied not only to a general soil ground but also to a soft ground for controlling of a slope or a sheet pile. In the present construction example, first, the distal end of a portion of the tension member 2 from which a covering material is removed is grasped by the wedge assembly 6 of the inner fixing body 4, and the grip sleeve 10 squeezing the permanent anchor 12 is threadedly coupled to the internal thread 8*b* of the coupler 8. In this way, complex anchor devices 30*a*, 30*b* and 30*c* are configured. The complex anchor devices 30*a*, 30*b* and 30*c* are inserted into an anchor hole 32 defined in the ground. Then, after filling a grout 34 in the anchor hole 32, a series of processes of applying a tension force to the PC steel wire 2*a* of the tension member 2 and fixing the complex anchor devices 30*a*, 30*b* and 30*c* by an external fixing body 38 installed on a slope 36 are performed.

In the construction, since a thread locking force greater than the tension force applied to the permanent anchor 12 in the bonded length section is secured between the coupler 8 and the grip sleeve 10, there is no probability of the permanent anchor 12 to be released.

When the anchor construction is completed, the tension member 2 performs a compression dispersion function for the grout in the free length section, and the permanent anchor 12 applies a tension force to the grout in the bonded length section, by which a frictional force between the ground and the grout can be increased and a high load can be retained with respect to the ground.

In the present construction example, as shown in FIG. 12, three complex anchor devices 30*a*, 30*b* and 30*c* are arranged in the anchor hole 32 so that a tension dispersion effect in the free length section and a tension force in the bonded length section can be maximized. In particular, it is illustrated in FIG. 12 that the permanent anchors 12 of the three complex anchor devices 30*a*, 30*b* and 30*c* are arranged through the entire bonded length section in such a way as to define step-like shapes. However, it is to be noted that the present invention is not limited to such an example, and the complex anchor devices 30 can be installed within a range capable of being accommodated by the block spacer 14 depending upon a ground condition (a soft ground or a general soil ground). In general, since the block spacer 14 is defined with 8 grooves 14*a* into which tension members can be received by being fitted, the complex anchor devices 30 can be arranged by the number of 2 to 8 (or 9). In the case where the anchor hole 32 has a substantial size and when an increased number of anchors are needed, the number of the grooves defined in the block spacer 14 may be increased.

Referring to FIG. 13, the step-like arrangement of the complex anchor devices 30*a*, 30*b* and 30*c* is maintained due to the fact that the tension members 2 of adjacent complex anchor devices 30*a*, 30*b* and 30*c* are fitted into the grooves defined in block spacers 14 which are fitted around couplers 8. By the step-like arrangement of the complex anchor devices 30*a*, 30*b* and 30*c*, the permanent anchors 12 corresponding to the respective step portions of the step-like shapes can successively disperse the load of the ground in such a way as to induce tension, by which a predetermined anchoring force can be secured not only in the general soil ground but also in the soft ground.

FIG. 14 shows a state in which the tension members 2 of the three complex anchor devices 30*a*, 30*b* and 30*c* fixed to the external fixing body 38 are surrounded by a PP-based textile 40.

After anchoring construction is completed in this way, by cutting each tension member 2 fixed by the external fixing body 38 using a welding machine and the like, the tension force is released. According to this fact, a reaction force corresponding to the tension force is applied to the tension member 2, and the wedge assembly 6 grasping the tension member 2 is pushed by the reaction force. As the wedge assembly 6 is pushed, the wedging force of the tension member 2 is released, and the PC steel wire 2*a* can be easily taken out from the PE tube 2*b* of the tension member 2.

Hereinbelow, a structure, in which a permanent fixing type anchor and a tension dispersion type anchor are separably combined with each other by using not a wedge but a thread for removal of a tension member, will be described.

Figure 15A:
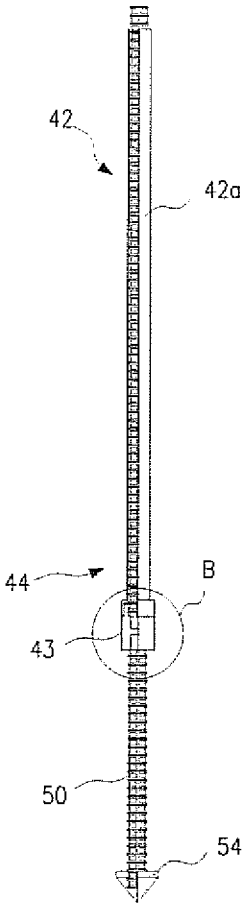
FIGS. 15A and 15B are partially cross-sectioned view views illustrating the configuration of a tension dispersion type complex anchor device with a removable tension member in accordance with a second embodiment of the present invention.
Figure 15B:
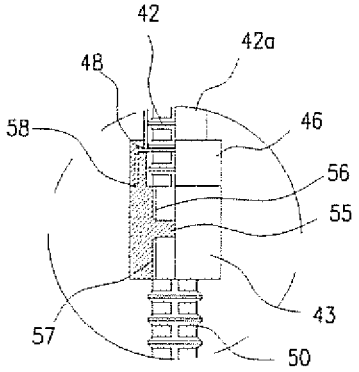

FIG. 15 is a partially cross-sectioned view illustrating the configuration of a tension dispersion type complex anchor device with a removable tension member in accordance with a second embodiment of the present invention.

The second embodiment of the present invention suggests a structure in which both the tension member of an internal fixing body and a permanent anchor are formed by deformed steel bars.

Referring to FIG. 15, the tension dispersion type complex anchor device in accordance with the second embodiment of the present invention includes a tension member 42 placed through a free length section to apply a tension force; an internal fixing body 44 having a fixing block 43 into which the distal end of the tension member 42 is fitted to be fixedly held and which has a partition wall 55 formed at the middle portion thereof; a first connection unit for detachably coupling the tension member 42 to the internal fixing body 44; a waterproof coupler 46 fitted around one end of the internal fixing body 44 to prevent the moisture from a grout or a foreign substance from being introduced into the internal fixing body 44 along the tension member 42; watertight rings 48 installed between the tension member 42 and the waterproof coupler 46 and between the internal fixing body 44 and the waterproof coupler 46; a permanent anchor 50 having a distal end which is fitted into the other end of the internal fixing body 44 to provide an allowable anchoring force through a bonded length section; a second connection unit for coupling the permanent anchor 50 to the internal fixing body 44; and a block spacer 14 (see FIG. 13) fitted around the internal fixing body 44 and defined on the circumferential outer surface thereof with a plurality of grooves 14*a* (see FIG. 13) in each of which the tension member 42 is to be fitted and supported.

A feature of the second embodiment of the invention resides in that a coupling force with respect to a grout can be increased by using only the permanent anchor 50 made of a deformed steel bar. In order to provide an increased coupling force between the permanent anchor 50 and the grout, in the second embodiment of the present invention, a support cone 54 is additionally provided to the proximal end of the permanent anchor 50. In this case, it is possible to provide a compression force and a coupling force together in the grout through the bonded length.

In the second embodiment of the invention, the fixing block 43 of the internal fixing body 44, serving as a joint block which performs a function of a medium for fixing the anchors through the free length section and the bonded length section, is formed with internal threads 56 and 57 on both ends thereof with the partition wall 55 formed at the middle portion thereof. A step portion 58 to be fitted by the waterproof coupler 46 is formed on the circumferential outer surface of one end of the fixing block 43.

Also, in the second embodiment of the present invention, the tension member 42 has a structure in which a deformed steel bar is inserted into a PE tube 42*a*, and the permanent anchor 50 is formed of a deformed steel bar which is not covered. The first and second connection units are constituted by the threads which are formed on the distal ends of the tension member 42 and the permanent anchor 50 made of deformed steel bars. Accordingly, the tension member 42 and the permanent anchor 50 can be separably locked into the internal threads 56 and 57 which are formed in the internal fixing body 44.

In particular, the tension member 42 is locked into the first internal thread 56 of the internal fixing body 44 such that, when tension dispersion is induced through the free length section and the tension force is released, the internal fixing body 44 can be easily separated and removed only through an operation of rotating the tension member 42. Therefore, the wedge assembly needed in the aforementioned embodiment for the removal of the tension member is not needed. Thus, the structure of the internal fixing body 44 can be simplified, and the manufacturing cost can be reduced.

While it is illustrated in the second embodiment that both the tension member 42 and the permanent anchor 50 are made of deformed steel bars, it is to be noted that the present invention is not limited to such. Instead, it is conceivable that at least one of the tension member 42 and the permanent anchor 50 can be made of a steel wire or a member capable of applying a tension force.

In a third embodiment of the present invention, a permanent anchor 50 is made of a deformed steel bar, and a tension member 42 is made of a steel wire instead of a deformed steel bar, which will be described with reference to FIGS. 16 and 17. In this third embodiment, the same reference numerals will be used to refer to the same component elements as those of the second embodiment.

Figure 16A:
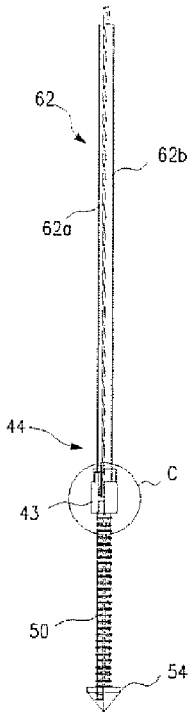
FIGS. 16A and 16B are partially cross-sectioned view views illustrating the configuration of a tension dispersion type complex anchor device with a removable tension member in accordance with a third embodiment of the present invention.
Figure 16B:
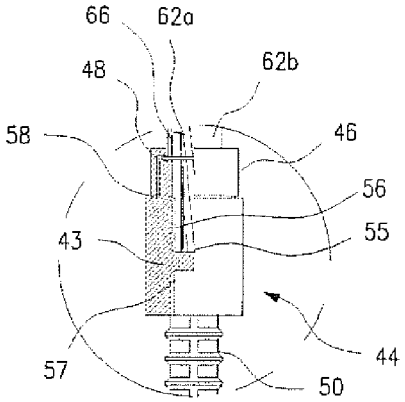
Figure 17A:
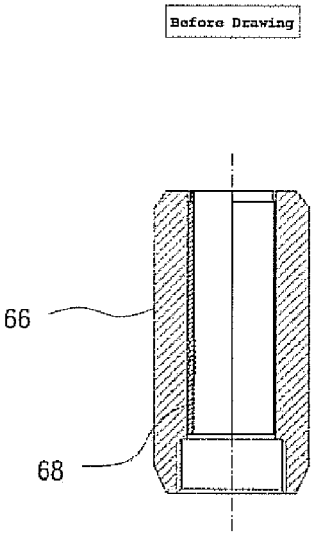
FIGS. 17A and 17B are cross-sectional view views illustrating a manufacturing process in which a grip sleeve is squeezed against a tension member in the third embodiment of the present invention.
Figure 17B:
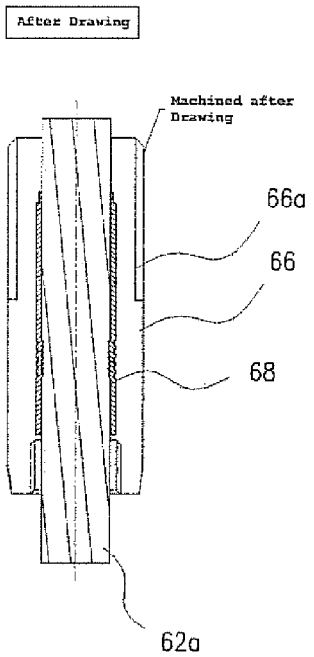

FIG. 16 is a partially cross-sectioned view illustrating the configuration of a tension dispersion type complex anchor device with a removable tension member in accordance with a third embodiment of the present invention, and FIG. 17 is a cross-sectional view illustrating a manufacturing process in which a grip sleeve is squeezed against a tension member in the third embodiment of the present invention.

Referring to these drawings, a tension member 62 has a structure in which a PC steel wire 62*a* formed by twisting a number of strands is covered by a PE tube 62*b*. The distal end of the tension member 62, from which the PE tube 62*b* is removed, is fixedly fitted into a grip sleeve 66 which is formed with an external thread 66*a* without causing a reduction in sectional area.

Referring to FIG. 17, the steel wire 62*a* is fixed to the grip sleeve 66 by squeezing through a drawing process. An insert plate 68 for increasing the fixing force of the steel wire 62*a* is attached to the inner surface of the grip sleeve 66. When the grip sleeve 66 is drawn through a dice (not shown), the diameter of the grip sleeve 66 is decreased, and the insert plate 68 is squeezed against and integrated with the steel wire 62*a*, as shown in the right side drawing of FIG. 17. An external thread 66*a* is formed on the circumferential outer surface of the grip sleeve 66 and is locked into a first internal thread 56 of the fixing block 43 so that the tension force applied to the tension member 62 can be sufficiently sustained by the locking force.

Figure 18:
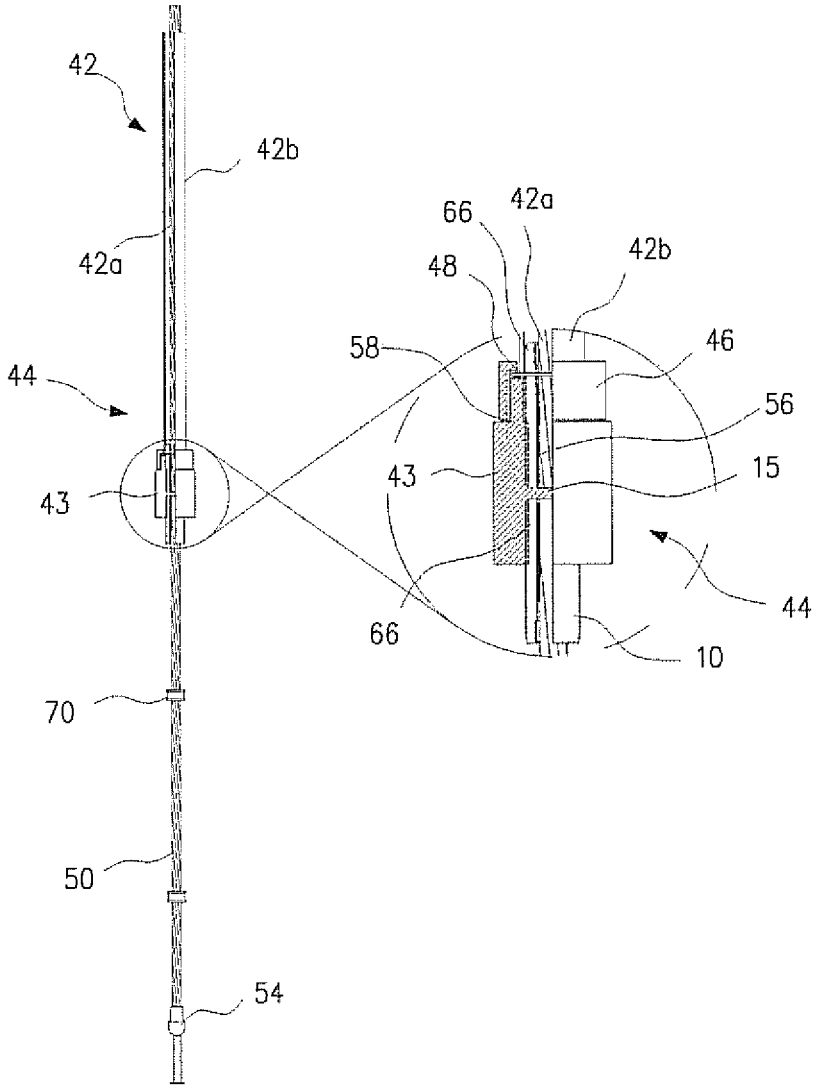
FIG. 18 is a partially cross-sectioned view illustrating the configuration of a tension dispersion type complex anchor device with a removable tension member in accordance with a fourth embodiment of the present invention.

FIG. 18 is a partially cross-sectioned view illustrating the configuration of a tension dispersion type complex anchor device with a removable tension member in accordance with a fourth embodiment of the present invention. In this fourth embodiment, the same reference numerals will be used to refer to the same component elements as those of the second and third embodiments.

In the fourth embodiment of the present invention, both a tension member 42 and a permanent anchor 50 are made of steel wires. Further, a grip sleeve 66 is installed on the ends of the tension member 42 and the permanent anchor through a drawing process, in such a way as to be separable from an internal fixing body 44.

A plurality of strand grips 70 are installed at regular intervals on the permanent anchor 50 to increase a coupling force with respect to a grout, and a support cone is installed on the end of the permanent anchor 50 to apply a compression force to the grout.

The complex anchor devices in accordance with the second to fourth embodiments are constructed in the same way as the complex anchor devices 30*a*, 30*b* and 30*c* in accordance with the first embodiment.

While the present invention has been described with respect to the specific embodiments, it will be apparent to those skilled in the art that various changes and modifications may be made without departing from the spirit and scope of the invention as defined in the following claims.

INDUSTRIAL APPLICABILITY

The present invention may be applied to a region where the strength of the ground is decreased due to large-scale land reclamation or construction of a road, a railroad and a tunnel, a region where a slope failure is likely to occur, a soft ground where the stabilization of the ground is required, and so forth.

The invention claimed is:

1. A tension dispersion type multiple anchor device comprising:

a tension member placed through a free length section to apply a tension force;

an internal fixing body having a wedge assembly which grasps a distal end of the tension member to induce a tension force and to allow the tension member to be removed when the tension force is released and a fixing block into and by which the wedge assembly is fitted and supported;

a connection medium unit having one end which is separably coupled to the fixing block;

a grip sleeve separably coupled to the other end of the connection medium unit;

a permanent anchor fixed by being fitted into the grip sleeve to provide an allowable anchoring force through a bonded length section; and a block spacer fitted around the connection medium unit and defined on a circumferential outer surface thereof with a plurality of grooves in each of which the tension member is fitted and supported.

2. The tension dispersion type multiple anchor device according to claim 1, further comprising:

a strand grip fitted around the permanent anchor to increase a coupling force with respect to a grout filled through the bonded length section.

3. The tension dispersion type multiple anchor device according to claim 1, further comprising:

an anchor body installed on one end of the internal fixing body to reinforce the tension member, ensure waterproofness with respect to grouting and prevent a steel wire from being released.

4. The tension dispersion type multiple anchor device according to claim 1, wherein the fixing block of the internal fixing body is formed with an internal thread on a distal end thereof, and wherein the connection medium unit comprises a coupler constituted by a cylindrical block which is formed with a partition wall at a middle portion thereof, both ends of which are formed with internal threads, and one end of which is formed with an external thread to be threadedly coupled with the internal thread of the fixing block.

5. The tension dispersion type multiple anchor device according to claim 1, further comprising:

an insert plate attached to an inner surface of the grip sleeve to increase a fixing force, wherein the permanent anchor and the grip sleeve are coupled with each other through a drawing process.

6. The tension dispersion type multiple anchor device according to claim 1, wherein at least one of the tension member and the permanent anchor comprises a deformed steel bar.

7. A method for constructing a tension dispersion type multiple anchor device comprising:

a first step of forming a multiple anchor device including a tension member placed through a free length section to apply a tension force; an internal fixing body having a wedge assembly which grasps a distal end of the tension member to induce a tension force and to allow the tension member to be removed when the tension force is released and a fixing block into and by which the wedge assembly is fitted and supported; a connection medium unit having one end which is separably coupled to the fixing block; a grip sleeve separably coupled to the other end of the connection medium unit; and a permanent anchor fixed by being fitted into the grip sleeve to provide an allowable anchoring force through a bonded length section;

a second step of fitting block spacers around couplers of at least two multiple anchor devices, fitting tension members of adjacent multiple anchor devices into grooves of the block spacers fitted around the couplers, and inserting the multiple anchor devices into an anchor hole such that permanent anchors of the multiple anchor devices are arranged in such a way as to define step-like shapes, fitting a plurality of strand grips at regular intervals around the permanent anchors in order to increase a frictional force between the permanent anchors and the grout;

a third step of filling a grout into the anchor hole and fixing the grout, applying a tension force to the tension members, and fixing the multiple anchor devices to an external fixing body which is installed on a slope;

a fourth step of cutting the tension members fixed by the external fixing body using a welding machine after anchoring construction is completed, and thereby releasing a tension force;

a fifth step of pushing wedge assemblies grasping the tension members as a reaction force corresponding to the tension force is applied to the tension members, and thereby a wedging force of the tension members is released; and a sixth step of taking out the tension members from internal fixing bodies.

8. A tension dispersion type multiple anchor device comprising:

an internal fixing body having a tension member which is placed through a free length section to apply a tension force and a fixing block to which a distal end of a steel wire of the tension member is separably coupled;

a first connection unit for coupling and decoupling the tension member to and from the fixing block of the internal fixing body;

a permanent anchor fixed by being fitted at a distal end thereof into the other end of the fixing block of the internal fixing body to provide an allowable anchoring force through a bonded length section; and a second connection unit for coupling the permanent anchor to the fixing block of the internal fixing body.

9. The tension dispersion type multiple anchor device according to claim 8, further comprising:

a block spacer fitted around the inner fixing body and defined on a circumferential outer surface thereof with a plurality of grooves in each of which the tension member is fitted and supported.

10. The tension dispersion type multiple anchor device according to claim 8, wherein the fixing block of the internal fixing body is constituted by a cylindrical joint block which is formed with internal threads on both ends thereof with a partition wall formed at a middle portion thereof, and wherein the first and second connection units are constituted by threads which are formed on distal ends of the tension member and the permanent anchor to be threadedly coupled to the internal threads of the fixing block.

11. The tension dispersion type multiple anchor device according to claim 8, wherein the fixing block of the internal fixing body is formed with internal threads on both ends thereof with a partition wall formed at a middle portion thereof and is formed with a step portion on a circumferential outer surface of one end thereof, wherein the tension dispersion type multiple anchor device further comprises:

a waterproof coupler fitted around the step portion of the fixing block to prevent moisture from a grout or a foreign substance from being introduced along the internal thread of the fixing block; and a watertight unit installed between the waterproof coupler and the step portion of the fixing block, and wherein the first and second connection units are constituted by threads which are formed on distal ends of the tension member and the permanent anchor to be threadedly coupled to the internal threads of the fixing block.

12. The tension dispersion type multiple anchor device according to claim 11, wherein the tension member comprises a covering material and one selected from a deformed steel bar and a steel wire each of which is covered by and tensioned in the covering material, wherein the permanent anchor comprises one selected from a deformed steel bar and a steel wire.

* * * * *